US006634258B2

(12) United States Patent
Pool et al.

(10) Patent No.: US 6,634,258 B2
(45) Date of Patent: Oct. 21, 2003

(54) AUTOMOTIVE HOSE CLAMP REMOVAL TOOL

(75) Inventors: James L. Pool, deceased, late of Clarinda, IA (US), by Karen Pool, executrix; Michael L. Whitehead, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 10/158,420

(22) Filed: May 30, 2002

(65) Prior Publication Data

US 2002/0178869 A1 Dec. 5, 2002

(51) Int. Cl.[7] ..... B25B 27/10

(52) U.S. Cl. ..... 81/9.3; 81/314; 81/485; 81/487; 29/237; 29/243.56

(58) Field of Search ..... 81/9.3, 485, 486, 81/301, 302, 129, 131, 487, 355, 126, 342, 314; 29/225, 229, 243.56, 237, 239, 268; 269/86, 6, 20, 21, 25, 26, 216, 228, 165, 43

(56) References Cited

U.S. PATENT DOCUMENTS

| | | | | | |
|---|---|---|---|---|---|
| 1,271,365 | A | * | 7/1918 | Reynolds, Jr. | 81/129 |
| 2,283,089 | A | * | 5/1942 | Pfauser | 254/104 |
| 3,705,581 | A | * | 12/1972 | Drake | 606/53 |
| 3,762,688 | A | * | 10/1973 | Leonhardt | 254/93 R |
| 4,141,262 | A | * | 2/1979 | Smith | 81/57.39 |
| 4,747,433 | A | * | 5/1988 | Dixon | 140/150 |
| 4,926,722 | A | | 5/1990 | Sorensen et al. | |
| 4,957,021 | A | * | 9/1990 | Helton | 81/57.44 |
| 5,009,134 | A | * | 4/1991 | Sorensen et al. | 81/487 |
| 5,022,137 | A | | 6/1991 | Sorensen et al. | |
| D320,919 | S | | 10/1991 | Sorensen | |
| 6,164,162 | A | * | 12/2000 | Furundzic | 81/9.32 |
| 6,276,236 | B1 | * | 8/2001 | Wu | 81/9.3 |
| 6,370,985 | B1 | * | 4/2002 | Wu | 81/9.3 |
| 6,386,532 | B1 | * | 5/2002 | Donovan et al. | 269/25 |

FOREIGN PATENT DOCUMENTS

| | | | | |
|---|---|---|---|---|
| DE | 2622 650 | * | 12/1977 | 81/9.3 |

* cited by examiner

*Primary Examiner*—Joseph J. Hail, III
*Assistant Examiner*—Hadi Shakeri
(74) *Attorney, Agent, or Firm*—Banner & Witcoff, Ltd.

(57) ABSTRACT

A manual trigger actuated automotive hose clamp release mechanism includes a flexible cable in a flexible tube. The cable and tube are attached respectively to opposed jaws designed to engage the end tabs of an automotive hose clamp and effect release of the hose clamp in response to movement of the cable relative to the tube. Mechanical advantage is gained by use of the manual trigger mechanism connected to the tube and cable in a manner enabling movement of the telescoping cable relative to the tube through which the cable extends thereby effecting movement of the jaws to release a hose clamp.

2 Claims, 3 Drawing Sheets

AUTOMOTIVE HOSE CLAMP REMOVAL TOOL

BACKGROUND OF THE INVENTION

In a principal aspect the present invention relates to an automotive tool, and more particularly, to an automotive tool designed to facilitate removal of hose clamps such as used to retain radiator hoses and other hoses appropriately connected in a vehicle engine compartment.

The use of flexible hoses to connect fluid ports associated with the cooling system of an internal combustion engine is well-known. Attachment of such hoses to the port connections is typically maintained by means of various types of clamping mechanisms which fit around the hose and engage it tightly to the port connection. A very common type of hose connector or clamp comprises a generally circular band which is fitted over the end of the hose and compresses the hose onto a port connection. The ends of the circular band comprise radially outwardly extending tabs which are spaced one from the other and may be engaged to release the clamp by compressing the tabs or moving the tabs toward one another. Often when a mechanic is attempting to remove such a clamp in order to replace or repair a hose or a port connection, access to the clamp may be so restricted that removal becomes extremely difficult. Thus, the fluid ports and hoses in many vehicle engine compartments are positioned in areas of the compartment that are generally not highly accessible or, if accessible, require a significant amount of contortion in order to effectively engage the clamp end tabs and compress those tabs using a pliers or other similar tool. Thus, there has developed a need for some means to effect compression of the end tabs of vehicle hose clamps in a manner which will enable their release of the hose from a port connector effectively and efficiently, particularly in areas where there is restricted access.

SUMMARY OF THE INVENTION

Briefly, the present invention relates to apparatus for removal of an automotive hose clamp and, more particularly, to a manual trigger actuated clamp release mechanism which includes a flexible cable in a flexible tube. The cable and tube are attached respectively to opposed jaws designed to engage the end tabs of an automotive hose clamp and effect release of the hose clamp in response to movement of the cable relative to the tube. Mechanical advantage is gained by use of the manual trigger mechanism connected to the tube and cable in a manner enabling movement of the telescoping cable relative to the tube through which the cable extends thereby effecting movement of the jaws to release a clamp.

Because the cable and tube are flexible, the jaws attached to the extreme ends thereof may be positioned in highly inaccessible regions of an engine compartment for engagement with a hose clamp. Actuation of the trigger mechanism then effectively releases the clamp from the hose. The apparatus may be used for removal of a hose clamp and for assisting in the attachment of a hose clamp.

Thus, it is an object of the invention to provide an improved apparatus for removal of an automobile hose clamp.

It is a further object of the invention to provide an apparatus for removal of an automotive hose clamp positioned in a generally inaccessible region or area of an engine compartment.

Another object of the invention is to provide an automotive hose clamp removal tool which includes a flexible cable and tube operatively connected to moveable jaw members that may be engaged with the end tabs of an automotive hose clamp to effect movement of those end tabs and release of the hose clamp.

Another object of the invention is to provide a mechanically simple, yet highly effective, inexpensive and rugged apparatus for removal and replacement of automotive hose clamps.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
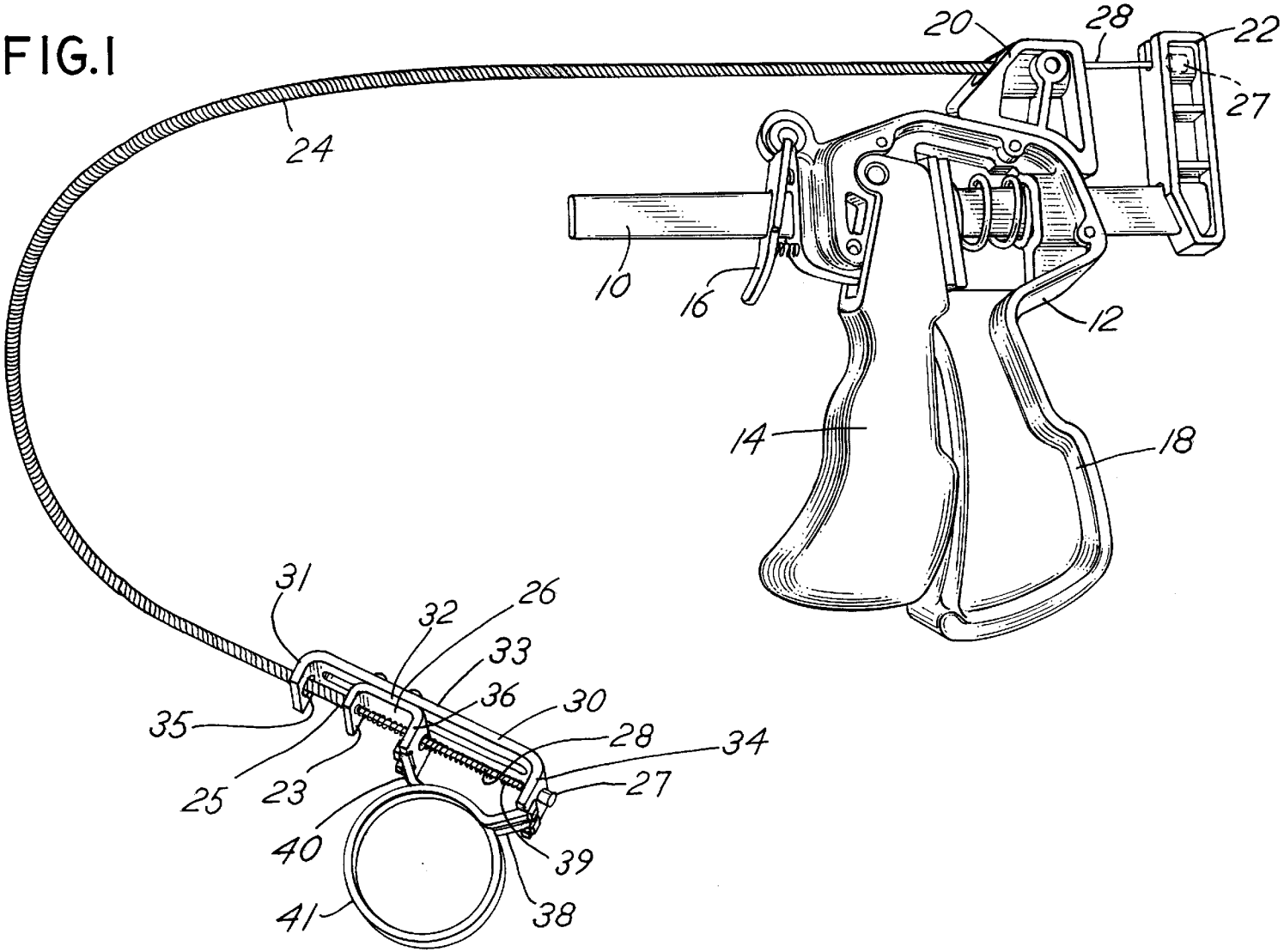
FIG. 1 is an isometric view of the tool.
Figure 2:
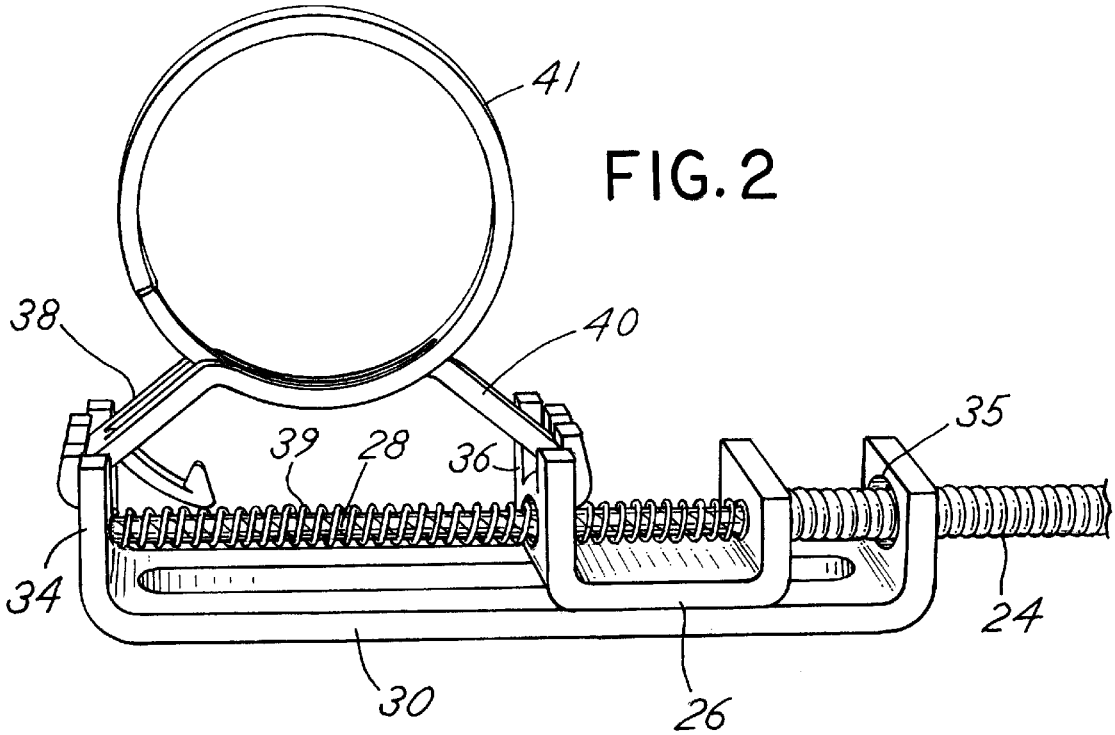
FIG. 2 is an isometric view of the clamp removal mechanism of the tool positioned to engage a hose clamp.
Figure 3:
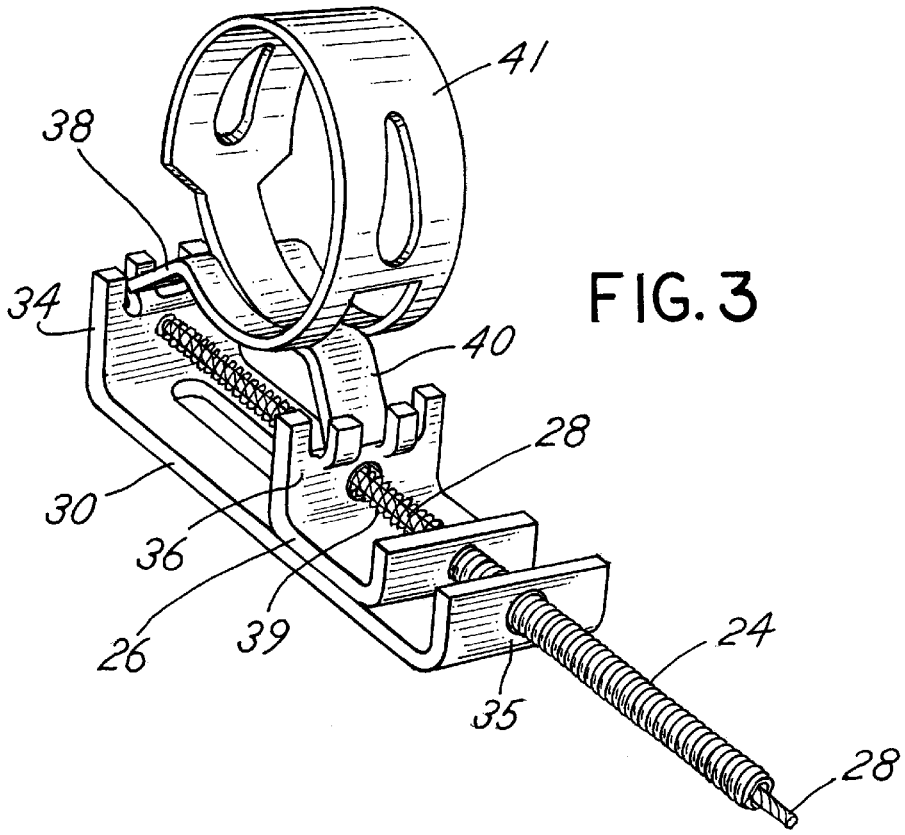
FIG. 3 is another isometric view of the clamp removal mechanism engaging a clamp.
Figure 4:
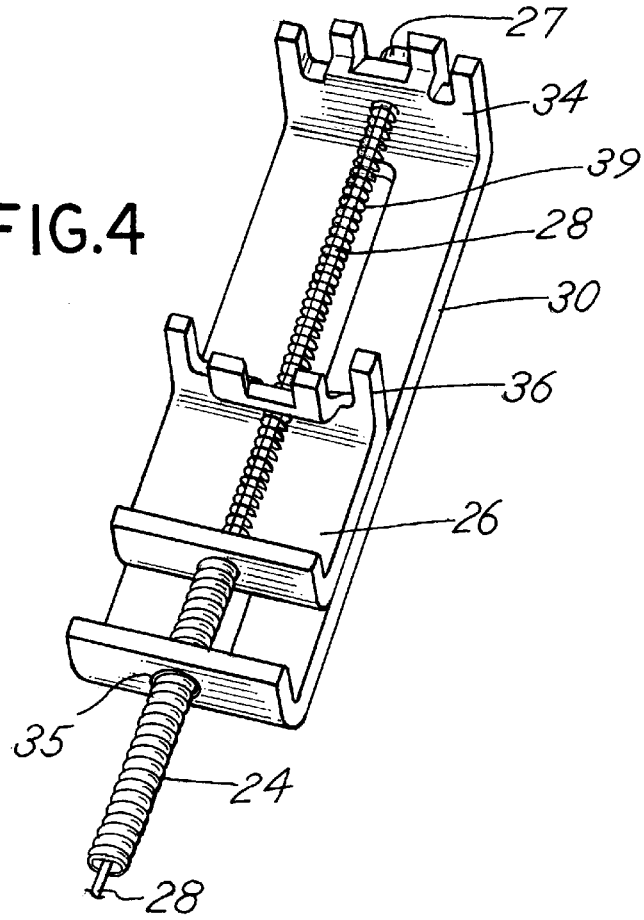
FIG. 4 is an isometric view of the jaws of the clamp removal mechanism.
Figure 5:
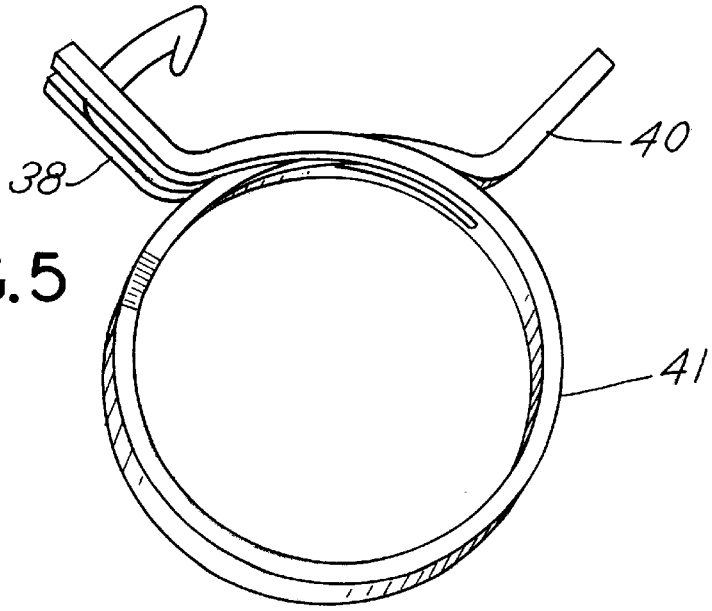
FIG. 5 is an isometric view of a typical hose clamp.

Referring to the figures, the device includes a manually driven bar or member 10 which is slidably mounted or retained in a housing 12. The bar member 10 may be retracted incrementally by a trigger member 14 pivotally mounted in the housing 12. A spring biased catch member 16 locks the bar 10 in a retracted position upon movement by operation or rotation of the trigger 14 in a first direction. The trigger 14 may thus be pivoted relative to the housing 12 and, more particularly, to the hand grip 18. The bar 10 is driven in a first direction by the trigger 14 and a frictional drive plate 17 to a retracted position, but may be released for reverse movement to an extended position by manual release of catch 16. A mechanism of this general type is depicted in U.S. Pat. No. 4,926,722 which is incorporated herewith by reference. However, it is to be understood that various types of mechanisms including ratchet mechanisms, rack and pinion mechanisms, and various other mechanisms may be utilized in order to provide a mechanical advantage, a means for driving a bar, such as bar 10, incrementally in a given direction, and means for release of the bar 10 when so desired. Additional patents directed to such a drive mechanism are incorporated herewith by reference and include the following: U.S. Pat. Nos. 5,009,134; 4,926,722; 5,022,137 and D320,919.

The housing 12 further includes a fixed upstanding plate or jaw 20 mounted thereon. A moveable, opposed plate or jaw 22 is mounted on the inner end of bar 10. Projecting from and attached to the fixed plate, jaw or member 20 is an elongate, flexible hollow tube 24 to which a U-shaped clamp 26 is resting against the free end 25 of tube 24. Attached to and projecting from the moveable jaw 22 is a telescopic rod or wire 28 which extends through the fixed jaw 20 and through the hollow tube 24. A stop 27 is fastened to the distal end of the flexible rod or cable 28 which prevents cable 28 from pulling through the end of a second U-shaped clamp 30 which is slidably attached to the crown 32 of the first clamp member 26 by headed bolts or rivets 33. Projecting leg or tab 34 from the U-shaped slidable clamp 30 and leg or tab 36 projecting from the U-shaped fixed clamp 26 are configured and designed to engage the exposed tangs 38 and 40, respectively, of an automobile hose clamp 41 and move them toward each other to release clamp 41.

Thus the U-shaped clamp 30 includes an upstanding end or leg 31 which connects with a crown 33 and then to a further upstanding leg 34. The upstanding leg 31 includes a passage or opening 35 through which the tube 24 may extend to engage against an upstanding leg 23 of the U-shaped clamp member 26 having a crown 32 and an upstanding leg 36 which, as defined above, comprises a tab 36 for engaging with a clamp 41. A biasing spring 39 is positioned over the rod or wire 28 and engages against the leg 23, passes through the leg 36, and engages at its opposite end in compression against the leg 34. The spring 39 thus biases the leg 23 and clamp 26 against the end 25 of tube 24 and causes the U-shaped clamp 30 to be biased against the stop 27. Thus, leg or tab 36 is positioned a fixed distance from end 25 of tube 24 and clamp 30 is slidable with respect thereto between an extended position and a retracted position. Retraction is effected by pulling the cable 28 to slide clamp 30 and leg 34 toward leg 36 of clamp 26. Spring 39 effects separation of leg 34 from leg 36 upon release of cable 28. Thus, leg 36 is freely slideable relative to spring 39 and leg 31 is slidable over tube 24.

Operation of the trigger 14 will cause the slidable clamp member 30 to slide with respect to the member 26 thereby causing the extended legs or tabs 34 and 36 to engage legs or tangs 38 and 40, respectively, in turn, causing legs or tangs 38, 40 to be driven and approach one another. This interaction effects release of the automobile hose clamp 41.

Because the cable 28 and the tube 24 are flexible, the clamp release mechanism may be positioned in very inaccessible or highly inaccessible places. The cable 28 and tube 24 are therefore elongate and preferably in the range of 2–3 feet in length. The release clamps 26 and 30, and more particularly, the active legs or extensions 34 and 36 thereof are configured to be spaced one from the other by approximately 2–3 inches when in the so-called extended position. Operation of the trigger mechanism will then move the legs 34 and 36 toward one another and thus toward a retracted position thereby effecting release of an automotive hose clamp. The travel necessary to effect such release will be in the range of 60–80% of the spacing between the legs 34 and 36; however, lesser amounts of movement result in adequate release.

The shape and configuration of the clamps 26 and 30 may be varied without departing from the spirit and scope of the invention. The length and size of the cable 28 and tube 24 may be varied. The specific trigger mechanism utilized may be significantly varied without departing from the spirit and scope of the invention. The invention is therefore limited only by the following claims and equivalents thereof.

What is claimed is:

1. An automobile hose clamp removal tool for release of a generally circular shaped hose clamp having first and second spaced, radially outwardly extending clamp release projecting tabs, said clamp removal tool comprising:

a housing having a top side;

a fixed plate mounted on the top side of the housing with a flexible tube extending from the fixed plate;

a telescoping bar slidably mounted on the housing extending generally parallel in the direction of the flexible tube;

a movable plate mounted on the slidable bar in opposed relation to the fixed elate;

a flexible cable attached to the movable plate, said cable telescopically extending through the flexible tube;

the tube and cable including respectively a first and a second U-shaped tab engaging member, for engaging respectively the first and second tabs of a hose clamp, said tab engaging members each including g crown and first and second spaced parallel legs, said crowns being in slidable contact and the legs extending in parallel, at least one leg of each tab engaging member including a projecting tab for engaging a hose clamp tab, said tab engaging member legs being spaced and movable relative to each other by movement of the movable plate and attached cable;

and a bar movement mechanism mounted on the housing for discretely and incrementally moving the movable plate relative to the fixed plate whereby actuation of the bar movement mechanism effects discrete and incremental movement of the tab engaging members engaged with first and second tabs to release the hose clamp.

2. The tool of claim 1 including a release member mounted on the fixed plate and manually movable for releasing the bar from incremental movement in one direction.

* * * * *